US006848372B2

(12) United States Patent
Alizade

(10) Patent No.: US 6,848,372 B2
(45) Date of Patent: Feb. 1, 2005

(54) MODULAR SECURITY SAFE WITH OFFSET SECURITY BOLT BOX HAVING EXPANDABLE CHARACTERISTICS AND METHOD OF MANUFACTURING SAME

(76) Inventor: Karl Alizade, 508 Fielders La., Toms River, NJ (US) 08755

( * ) Notice: Subject to any disclaimer, the term of this patent is extended or adjusted under 35 U.S.C. 154(b) by 3 days.

(21) Appl. No.: 10/694,195

(22) Filed: Oct. 27, 2003

(65) Prior Publication Data

US 2004/0083935 A1 May 6, 2004

Related U.S. Application Data

(60) Continuation-in-part of application No. 10/145,402, filed on May 14, 2002, now Pat. No. 6,637,353, which is a continuation-in-part of application No. 09/928,647, filed on Aug. 13, 2001, now Pat. No. 6,386,122, which is a continuation-in-part of application No. 09/526,388, filed on Mar. 16, 2000, now Pat. No. 6,273,007, which is a division of application No. 09/271,714, filed on Mar. 18, 1999, now Pat. No. 6,044,776.

(51) Int. Cl.[7] ..... E04B 2/02

(52) U.S. Cl. ..... 109/78; 109/79; 220/4.33; 312/257.1

(58) Field of Search ..... 109/78, 79; 52/270, 52/284; 220/4.33; 312/257.1, 140, 263, 265.5

(56) References Cited

U.S. PATENT DOCUMENTS

| | | | | | |
|---|---|---|---|---|---|
| 70,202 | A | * | 10/1867 | Hall | 109/79 |
| 115,728 | A | * | 6/1871 | Hall | 109/74 |
| 281,640 | A | * | 7/1883 | Mosler | 109/79 |
| 328,113 | A | * | 10/1885 | Farrel | 109/56 |
| 470,017 | A | * | 3/1892 | Simmons | 109/79 |
| 1,108,105 | A | * | 8/1914 | Rees | 109/79 |
| 1,669,486 | A | * | 5/1928 | Edwards | 109/59 R |

(List continued on next page.)

FOREIGN PATENT DOCUMENTS

| | | | | |
|---|---|---|---|---|
| DE | 341015 | * | 9/1921 | 109/84 |
| DE | 2614968 | * | 10/1977 | |
| GB | 153998 | * | 11/1920 | 109/83 |
| GB | 182114 | * | 9/1923 | |
| GB | 2081335 | * | 2/1982 | |
| WO | WO93/06328 | * | 4/1993 | |

*Primary Examiner*—Lloyd A. Gall
(74) *Attorney, Agent, or Firm*—Clifford G. Frayne

(57) ABSTRACT

The modular security safe with offset security bolt box of the present invention includes a number of modular panels which serve as the top, bottom, and sides of the safe. The modular panels of the safe are cast in a plastic or metal mold with high-density concrete reinforced by expanded metal. The modular panels included outer portions and stepped or rabbeted inner portions. The panels are formed from a sheet of material bent to a desired form. Concrete is poured in to the panel, in a single pour step. The panel is vibrated to allow the concrete to settle, and the concrete is allowed to set. The outer surface can then be covered with a desired laminate. The panels have security bolt boxes attached by bolts to the inner portions thereof. Security bolt boxes comprise a tray having a bottom and upstanding walls, and they can be formed by bending a single sheet of material. The modular side panels are attached to the top and bottom panels by bolts extending through the security bolt boxes. This results in a construction where the bolts are offset from the seams of the safe and therefore, the bolts, and the safe, are not subject to easy attack. Further, multiple panels are interconnected by a filler panel and security boxes to allow for the expandability of a safe to a larger size, such expansion being capable of being accomplished in situ.

5 Claims, 11 Drawing Sheets

U.S. PATENT DOCUMENTS 1,828,436 A * 10/1931 Paca ..... 109/84
3,732,831 A * 5/1973 Marciniak et al. ..... 109/83
4,048,926 A * 9/1977 Brush et al. ..... 109/65
4,158,338 A * 6/1979 Dippold et al. ..... 109/79
4,377,977 A * 3/1983 Wurster ..... 109/83
4,388,874 A * 6/1983 Stone ..... 109/79
4,389,948 A * 6/1983 Sands et al. ..... 109/82
4,422,386 A * 12/1983 Carpenter ..... 109/59 R
4,426,935 A * 1/1984 Nikoden, Jr. ..... 109/79
4,455,801 A * 6/1984 Merritt ..... 52/309.9
4,559,881 A * 12/1985 Lankard et al. ..... 109/83
4,662,288 A * 5/1987 Hastings et al. ..... 109/2
5,014,593 A * 5/1991 Auyer et al. ..... 89/36.02
5,488,914 A * 2/1996 Ouellette ..... 109/56
5,860,268 A * 1/1999 McWilliams ..... 52/784.11
6,044,776 A * 4/2000 Alizade ..... 109/78
6,273,007 B1 * 8/2001 Alizade ..... 109/49.5
6,386,122 B2 * 5/2002 Alizade ..... 109/78
6,637,353 B2 * 10/2003 Alizade ..... 109/78

* cited by examiner

MODULAR SECURITY SAFE WITH OFFSET SECURITY BOLT BOX HAVING EXPANDABLE CHARACTERISTICS AND METHOD OF MANUFACTURING SAME

RELATED APPLICATIONS

This is a continuation-in-part application of U.S. patent application Ser. No. 10/145,402, filed May 14, 2002, now U.S. Pat. No. 6,637,353, which was a continuation-in-part application of application Ser. No. 09/928,647, filed Aug. 13, 2001, now U.S. Pat. No. 6,386,122, which was a continuation-in-part application of application Ser. No. 09/526,388, filed Mar. 16, 2000, now U.S. Pat. No. 6,273,007, which was a divisional of application of application Ser. No. 09/271,714, filed Mar. 18, 1999, now U.S. Pat. No. 6,044,776. The entire disclosures of these related applications are expressly incorporated herein by reference. The entire disclosures of these related applications are expressly incorporated herein by reference.

BACKGROUND OF THE INVENTION

1. Field of the Invention

The present invention relates generally to security safes and vaults, and more particularly to a modular security safe or vault constructed of a plurality of interconnected panels, the security safe or vault having expandability characteristics by increasing the number of modular interconnected panels so as to increase the size of the safe or vault which increase in size can be accomplished in situ.

2. Description of the Prior Art

Security safes and vaults are used for a wide variety of protection. Security safes and vaults can be room size as in the case with many bank safes or vaults and can vary in size down to a wall safe utilized in homes and offices. The sizes and scales of such safes and vaults can vary widely between these two extremes. Applicant is the holder of a series of patents, U.S. Pat. No. 6,044,776 and a divisional and continuation-in-part applications which have matured into patents set forth above there from for modular safes which would typically be utilized at the smaller size end of the safe vault continuum. Applicant's module safes allow the safes or vaults to be assembled in situ and still provide superior security and integrity and weight to the typical smaller safes utilized heretofore which could be easily breached or in many instances completely removed from the premises for being breached.

Security safes for the household protection of valuables, currency storage at convenient stores, and other small security applications are in wide scale use. Typically, safes employed for such applications are much smaller and lighter than those used in banks and other high security situations. The need for the smaller and lighter design is to facilitate the delivery and placement of these safes in houses and buildings typically not designed to withstand the weight of a large safe (4000–6000 pounds) or the prohibitive size of the safe.

As a result, these lighter safes typically serve only as a deterrent to burglary attempts rather than a sophisticated defense against professional burglary.

In order to increase the security of small application security safes, efforts have been made to design modular safes which can be moved piece by piece to a location where it will be used and then assembled. The modular style safe allows for ease of transportation, but prevents such transportation once assembled. It also provides a higher degree of security than other small application safes which, in some instances, can be carried away from the location.

However, despite the increased weight of modular safes currently known, the very nature of the modular design reduces the security of such a safe in comparison to a one-piece cast safe. Up until now, modular security safes, by the very nature of being modular in design, have been ineffective in preventing attacks by professional burglars. While modular safes are an improvement upon previous minimum security safes which can be carried away or easily attacked, modular safes, while immobile, still are vulnerable at the points of connection between the plurality of components that make up the safe.

Accordingly, what is desirable and has not heretofore been developed, is a modular safe which has the desired benefits of immobility and strength, with the added advantages of being impervious to attack at the critical joints of the modular pieces.

Some of the numerous efforts to provide modular safes are as follows:

Quellette, U.S. Pat. No. 5,488,914, discloses a security device for boxes. The security device includes a cabinet device which has an open top section into which a bottom portion of the box which is to be secured is inserted into the upper inner portion of the cabinet device. The bottom base includes a locking device for securing the cabinet onto a supporting surface such as a floor.

Nikoden, Jr., U.S. Pat. No. 4,426,935, discloses a case for securing valuables which includes a plurality of interconnected panels defining an interior space. The individual panels are readily transportable for convenient location and assembly; however, the case, once assembled, cannot be so readily moved from its location. Some of the panels employed include inside-facing surfaces and connectors such as threaded studs, while cooperating connectors such as openings for receiving the studs are defined by other panels, so that upon assembly of the respective panels, access to the connectors is available only from within the interior of the case. The device further discloses top and bottom panels which are interconnected to the side walls of the enclosure. The bottom panel is fitted with filler plates to eliminate any gaps along the bottom side edges of the case. It is further disclosed that said panels may be made of sheet metal, having 90 degree bends for forming the respective panel side edges. A double bend is then utilized for forming the respective lips which prevent access to the interconnecting bolts from the exterior of the security space.

Sands, et al., U.S. Pat. No. 4,389,948, discloses a vault constructed by assembling together a plurality of separate, pre-fabricated panels. Each perpendicular comer of the assembled vault is provided in a panel which extends integrally from the respective comer to define significant portions of both of the adjacent sides of the vault, thereby avoiding the security weakness of separate orthogonally-jointed panes at these comers. Each panel additionally comprises a steel plate upon which is cast a barrier material of high penetration resistance, but relatively low weight, fiber-reinforced concrete.

In one arrangement, there are four comer panels with two of said panels being interconnected by a uni-planar panel to define a first side of the assembled vault, and a space between the free edges of the other two said comer panels to define a door opening for the assembled vault on a second side thereof opposite to said first side. Said uni-planar panels also serve to provide as the top and bottom of the enclosed structure. These uni-planar panels can be inserted in multiple groups in order to form an increasingly large vault space. Except for the edges of the panels which define the door opening, each panel is formed around its edges to provide half lap joints which interfit with the corresponding formations on the neighboring panels. The overlapping joints, so-formed, insure accurate relative location of the panels and preclude the possibility of direct access being gained to the interior of the vault through the joints. All panel-to-panel connections are made internally, and none of the fixing is visible from the exterior of the vault. Each joint between adjacent comer and uni-planar panels is secured by means of a steel flitch plate which is welded along the vertical edge of one of the abutting panels and has a series of drillings which align with tapped holes along the vertical edge of the uni-planar panel, the screws being passed through the flitch plate and into the hole. Joints between the comer and rear panels and the floor and roof panels are similarly secured by steel angles which have a series of joints in each leg, which align with tapped holes along the adjacent horizontal edges of the panels, the screws being similarly passed through the angles and into the holes. In order for these joint angles to function as one structure, they must be welded together. The reinforced concrete layer of the panels is evenly distributed with randomly oriented masses of steel fibers providing a density in the range of 14,000 pounds per square inch.

Sands, et al, G.B. Patent No. 2,081,335, is the British counterpart to the above-described patent issued to Sands, et al., U.S. Pat. No. 4,389,948.

Stone, U.S. Pat. No. 4,388,874, discloses a prefabricated concrete vault with a plurality of concrete members having jointed overlapping connections with adjacent members with peripheral edges thereof having offset surfaces for each other across the seam of the joint to provide noncontinuous burglar-proof seams. In other words, in each of such joints, edge surfaces formed by the groove or rabbet-type overlap provide surfaces or edges which are offset from each other so that there is no straight-through seam or direct path of entry. A plurality of metal plates are anchored along the edges of the panels and are welded together to join the panels together.

While a minimum of exterior seams are visible, giving the appearance of a permanent-type installation, the weld plates, which are welded into position in order to hold the separate portions together can easily be released from each other merely by burning out the welds and the component parts can then be transported away from the site. The result is a security safe which is highly secure in nature, but at the same time highly transportable, if necessary.

Dippold, et al., U.S. Pat. No. 4,158,338, discloses a wall panel consisting of two units that can be interconnected with other panels engaging each other in a rabbet joint in which the projecting core layer parts are spacedly superimposed on each other to provide a burglar resistant connection between the panels which themselves are difficult to penetrate by burglar's tools.

Each of the rectangular panels is formed with rabbets in its four narrow, elongated-edge portions which extend between the major inner and outer faces of each panel. Rabbet joints connect several of the panels to form a continuous box structure when the door is closed. The box structure is covered by outer and inner cases of relatively thin sheet metal welded along the edges of the safe. Each of the panels is made up of a combination of sintered aluminum oxide and perforated sheet metal. For greater resistance to burglary, the core layers of adjacent wall panels overlap each other. The layer in one unit of each panel thus extends beyond the corresponding layer of the other unit in the direction of panel width or length by at least ¼ of the total panel thickness. The panels further consist of a third fiber-reinforced elastomeric material, such as natural or synthetic rubber, which fills the interstices between the particles in each shell, the perforations of the shell walls and partitions, and completely covers all faces of the shell in an approximately uniform layer.

Simmons, U.S. Pat. No. 470,017, discloses an improved safe which can be easily taken to pieces so that it can be easily carried in sections; thereby obviating the immense amount of time and labor usually required in moving a safe. After moving the safe, it can be easily and quickly built up again and placed in condition for use. The separate pieces are combined via V-shaped tongue and groove longitudinal edges. The bottom of the safe is provided with a deep groove socket in its upper surface, located near and parallel with the two sides and back of said bottom section or plate. This socket or seal is tapered downwardly or V-shaped in cross section and the longitudinal sides of the socket or seal are formed longitudinally irregular, as by a series of steps or rabbeted-out portions. The top plate or section of the safe is provided with a correspondingly similar socket or seal. The two sections of the body of the safe are formed at their outer edges with a tongue or projection, in length and in cross-section similar and corresponding to the two sockets, so that when the lower section of the body is placed in position, its tongue or tapered projection and lower edge will rest and fit snugly in the seal and the outer surfaces of the sections will be flush with the outer edges of the bottom plate.

Farrel, U.S. Pat. No. 328,113, discloses a fire-proof safe with an outer shell and frame of metal and an inner frame of fire resistant material such as calcined gypsum, and/or hydraulic cement.

Hall, U.S. Pat. No. 115,728, discloses a non-modular safe which can be progressively strengthened through the addition of additional thicknesses of steel or other type of metal plate to be safe.

Hall, U.S. Pat. No. 70,202, discloses a safe upon which angle-irons are secured to the inner series of plates by rivets or screws with the angle-irons occupying all of the corners of the interior of the safe. The interior series of plates are dove-tailed into each other, one or more dove-tails of one plate entered into dove-tailed mortises in the edges of the adjoining plate or plates.

Applicant has further developed the modular concept of safe or vault to include the ability to expand the safe or vault to a larger size utilizing the modular concept which would allow for an individual or entity having a safe or vault already installed of one particular size to be able to expand that safe or vault in situ, by utilizing additional modular panels and security devices such that the size of the safe or vault could be expanded in a geometric progression.

With Applicant's module and expandability characteristics, the time, expense and labor of moving and installing a safe or vault are obviated. Applicant's panels are limited to a weight of 200 pounds per panel and can allow for the installation and construction of a safe or vault without a third parties knowledge that a safe or vault has been installed. Still further, the modularity and expandability characteristics allow for the expansion of an existing safe or vault constructed of Applicant's modular panels to be accomplished without third parties knowledge of such expansion or existence of such safe or vault. This concept alone further heightens the security of the safe or vault. Since if no one knows of its existence except for the owner and the installer, no temptation exists to burglarize the safe or vault.

None of these efforts, taken either alone or in combination, teach or suggest all of the benefits and the utility of the present invention.

OBJECTS OF THE INVENTION

It is a primary object of the present invention to provide a high security modular safe.

It is another object of the present invention to provide a modular safe which can be easily transported in pieces to a location and assembled at the location.

It is an additional object of the present invention to provide a modular safe which can be installed at locations where it would be impossible to install an entire, pre-made safe.

It is even an additional object of the present invention that upon assembly, the modular safe of the present invention is difficult, if not impossible, to remove from the location by conventional means.

It is still even an additional object of the present invention to provide a modular safe wherein components are joined by way of a security bolt box from the interior top and bottom sides of the safe.

It is even an additional object of the present invention that the security bolts boxes be located in an offset relation to the seam between the sides and top or bottom sections.

It is still even a further object of the present invention that the top and bottom of the safe have a smaller inner portion and a larger outer portion and a rabbet or step there between.

It is even another object of the present intention to step out outer portion of the top and bottom sides to give the illusion that there are no seams.

It is even an additional object of the present invention to provide a modular safe that is suitable for mass production.

It is yet another object of the present invention to provide a modular safe having panels formed of a shell into which concrete is poured in a single pour step.

It is even an additional object of the present invention to provide a modular safe that is inexpensive to manufacture and easy to install.

It is still a further object of the present invention to provide a modular safe which can be assembled to have a greater or smaller size by using more or less components.

It is even a further object for each of the panels to have an outer portion and a recessed inner portion, which inner portion is recessed from the edge of the outer portion on all four sides.

SUMMARY OF THE INVENTION

The modular security safe with offset security bolt box of the present invention includes a number of modular panels which serve as the top, bottom, and sides of the safe. The modular panels of the safe are cast in a plastic or metal mold with high-density concrete reinforced by expanded metal. The modular panels included outer portions and stepped or rabbeted inner portions. The panels are formed from a sheet of material bent to a desired form. Concrete is poured in to the panel, in a single pour step. The panel is vibrated to allow the concrete to settle, and the concrete is allowed to set. The outer surface can then be covered with a desired laminate. The panels have security bolt boxes attached by bolts to the inner portions thereof Security bolt boxes comprise a tray having a bottom and upstanding walls, and they can be formed by bending a single sheet of material. The modular side panels are attached to the top and bottom panels by bolts extending through the security bolt boxes. This results in a construction where the bolts are offset from the seams of the safe and therefore, the bolts, and the safe, are not subject to easy attack.

In another embodiment, the security bolt box of the present invention includes top, bottom and side panels for form a safe. Opposing side panels have security bolt boxes attached thereto. The security bolt boxes each comprise a tray having a bottom and upstanding walls and can be formed by bending a single sheet of material. The top, bottom and back panels are interconnected with the side panels by bolts extending through the security bolt boxes into the top, bottom and back panels. In a further embodiment, multiple panels are interconnected by a filler panel and security boxes to allow for the expandability of a safe to a larger size, such expansion being capable of accomplished in situ.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1A:
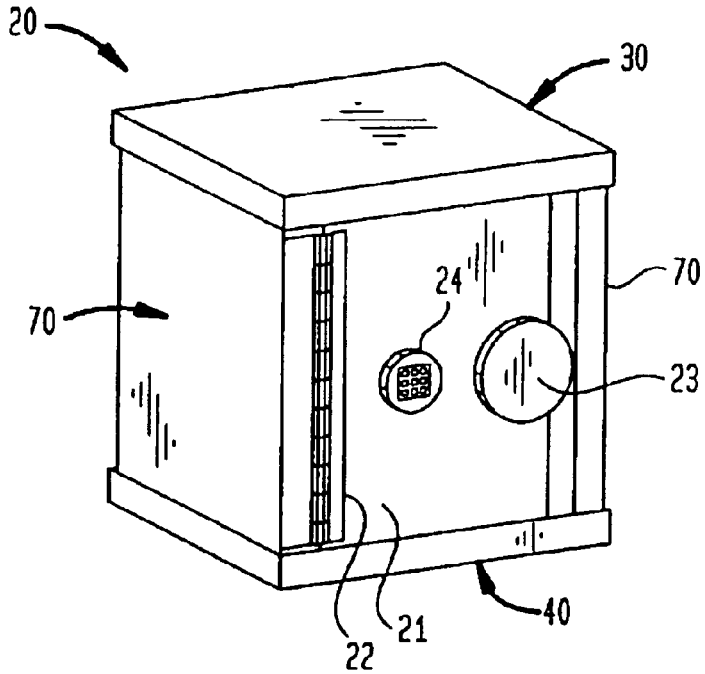
FIG. 1*a* is a perspective view of the modular security safe of the present invention shown in an assembled form.
Figure 1B:
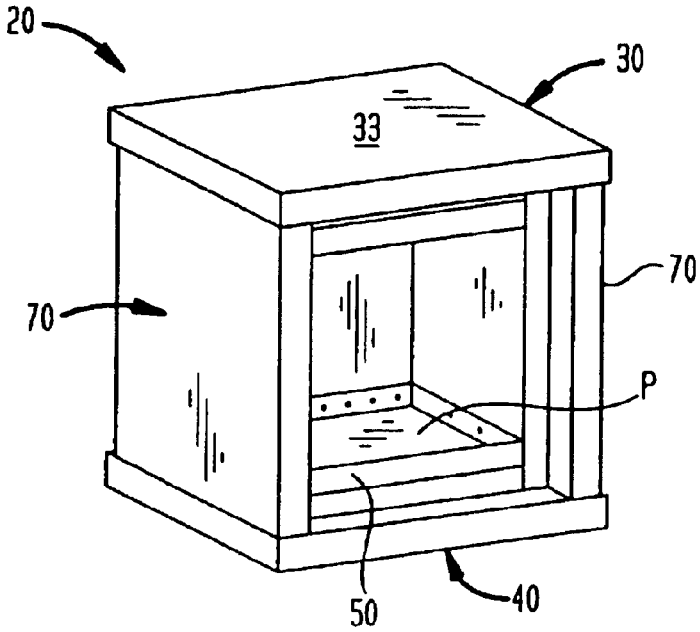
FIG. 1*b* is a perspective view of the apparatus of FIG. 1*a* with the door of the safe removed.
Figure 1C:
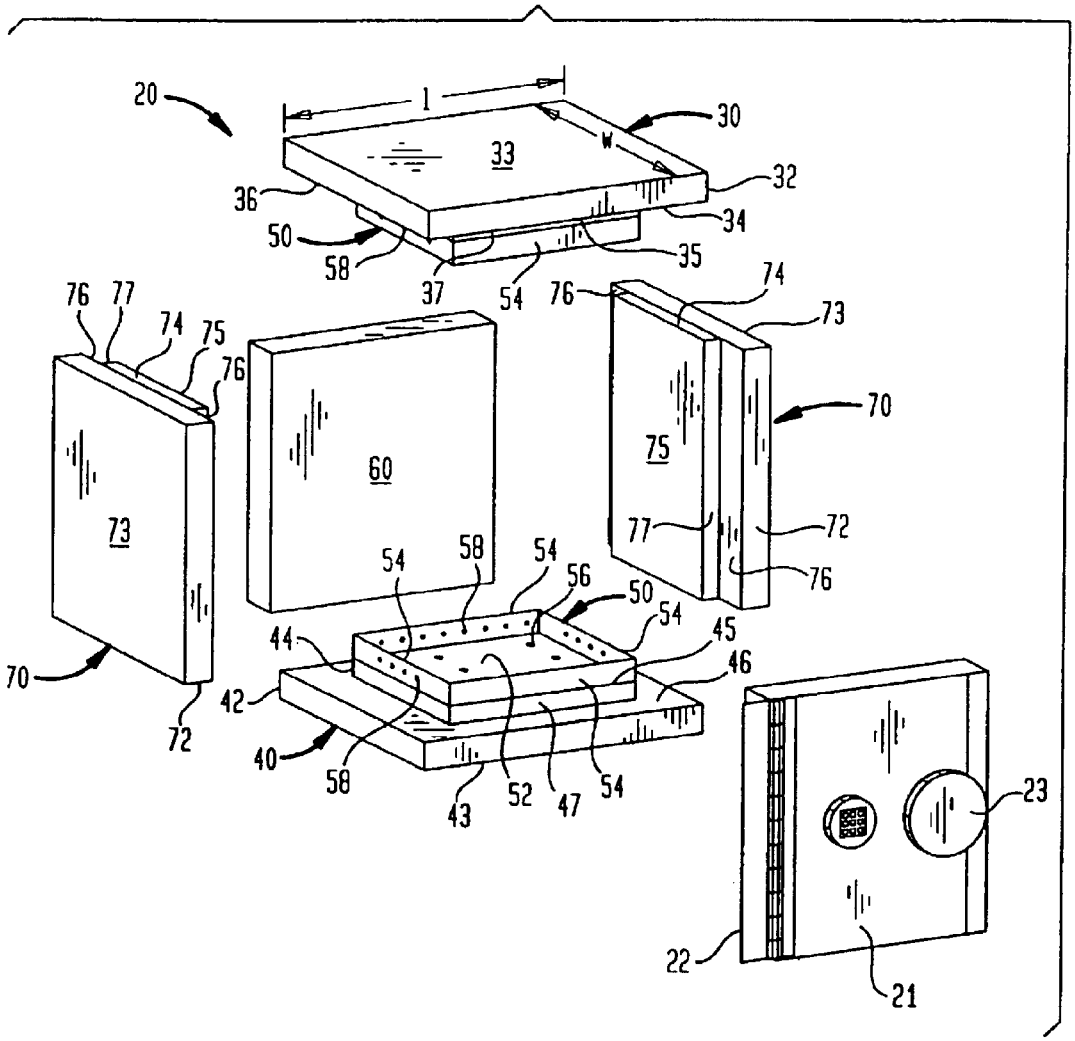
FIG. 1*c* is an exploded perspective view of the apparatus of FIG. 1*a*.

The improved modular security safe with offset security bolt box of the present invention is shown in FIGS. 1*a*, 1*b*, and 1*c*. The safe is generally indicates at 20. The safe 20 comprises a door 21 attached by a hinge 22. The door 21 further includes a handle 23 for opening and closing the door. Combination lock means 24 is also provided in connection with the door 21 of safe 20.

As can be seen in FIG. 1*a* and in more detail in FIGS. 1*b* and 1*c*, the modular safe 20 includes a top panel 30, a bottom panel 40, a back panel 60 and side panels 70. These panels, 30, 40, 60, and 70, the structure of which will be further discussed hereinafter, are interconnected by means of security bolt boxes 50 which attach the panels together to form the safe 20.

Top panel 30 includes an outer portion 32 with an outer surface 33 and an inner portion 34 with an inner surface 35. The inner portion 34 is generally smaller than the outer portion 32 in terms of length 1 and width w. A rabbet face 36 is created on the outer portion 32. The rabbet face 36, in connection with the perimeter 37 of the inner portion 34, forms a step between the inner portion 34 and the outer portion 32.

Similarly, the bottom panel 40 includes an outer portion 42 with an outer surface 43 and an inner portion 44 with an inner surface 45. The inner portion 44 is generally smaller than the outer portion 42 in terms of length l and width w. A rabbet face 46 is created on the outer portion 42. The rabbet face 46, in connection with the perimeter 47 of the inner portion 44, forms a step between the inner portion 44 and the outer portion 42.

Attached to the inner surface 35 of the inner portion 34 of the top panel 30 is a security bolt box generally indicated at 50. Likewise, a security bolt box 50 is attached to the inner surface 45 of the inner portion 44 of the bottom panel 40. The security bolt box 50 includes a bottom face 52 and upstanding walls 54 to form a tray-like configuration. The upstanding walls 54 can be interconnected with the bottom face 52 or can be formed through a bending and folding operation that will be hereinafter described. The security bolt box 50 is attached to the inner portion 34 of top panel 30 and inner portion 44 of bottom panel 40 by means of anchor bolts (not shown) which extend through anchor bolt apertures 56 in the security bolt box 50. The security bolt box 50 is also provided with attachment bolt apertures 58 extending about the upstanding walls 54 for receiving attachment bolts (not shown) to attach side panels 70 and back panel 60 with the top and bottom panels 30 and 40 to form the safe.

The back panel 60 is a generally rectangular wall formed with a plurality of bolt apertures along upper and lower edges for interconnecting with the security bolt box 50 by attachment bolts.

Side panels 70 include outer portions 72 and inner portions 74. The outer portion 72 includes an outer surface or facia plate 73, and the inner portion 74 includes an inner surface 75. Like the top panel and bottom panel, the inner portion 74 is stepped in relation to the outer portion 72 creating a rabbet face 76, which extends the length of the side panels, in a direction orthogonal to width W of the top panel 30 and bottom panel 40. However, unlike the top panel 30 and the bottom panel 40 which are stepped down on all four sides, the top and bottom surfaces of the inner portion 74 remain flush with the outer portion 72. Again, upper and lower edges of the inner surfaces 75 of the side panels 70 include apertures for receiving attachment bolts (not shown) that extend through the security bolt boxes 50 to join the side walls 70, back wall 60 and top and bottom panels 30 and 40.

Figure 2:
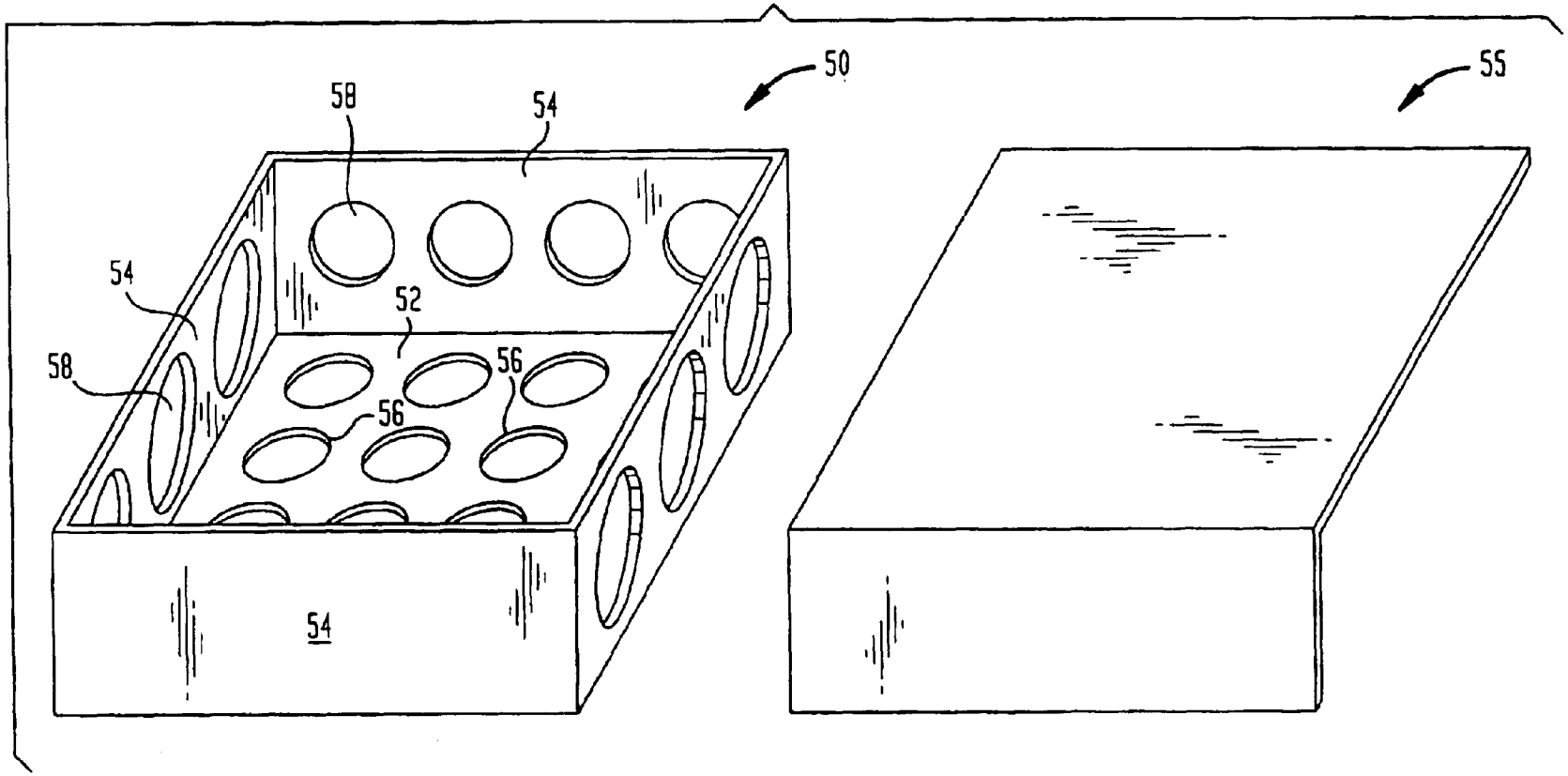
FIG. 2 is a perspective view of the security bolt box for use in assembling the modular safe of the present invention.

Referring now to FIG. 2, a perspective view of the security bolt box 50 is shown. Again the security bolt box includes a bottom face 52 and upstanding side walls 54. The box can be formed from a single sheet of metal with cut out comers and edges bent up to form the flat piece into a tray. Anchor bolt apertures 56 are punched through the bottom face 52 for attachment of the security box 50 to the inner surfaces 35 and 45 of the inner portions 34 and 44 of top and bottom panels 30 and 40. Attachment bolt apertures 58 are punched through the upstanding walls for attachment of the security box to top panel 30, back panel 60 and side panels 70.

Figure 3A:
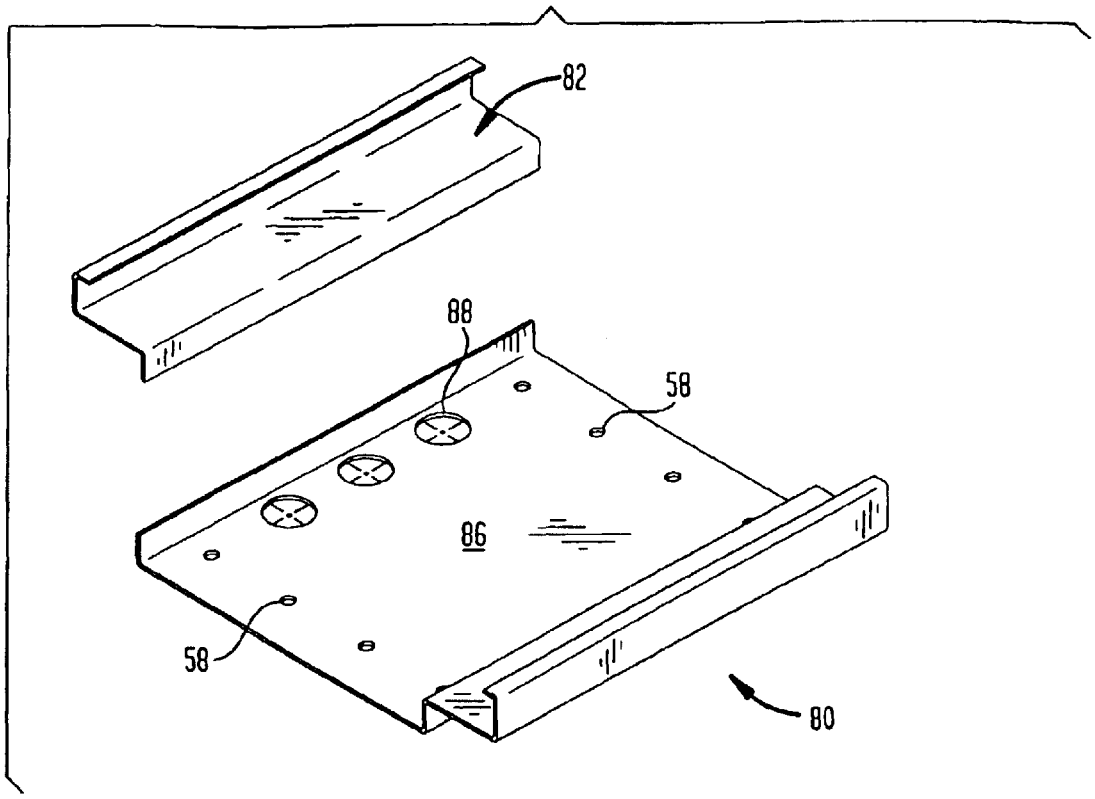
FIG. 3*a* is a perspective view of a side panel shell in a first stage of manufacture.
Figure 3B:
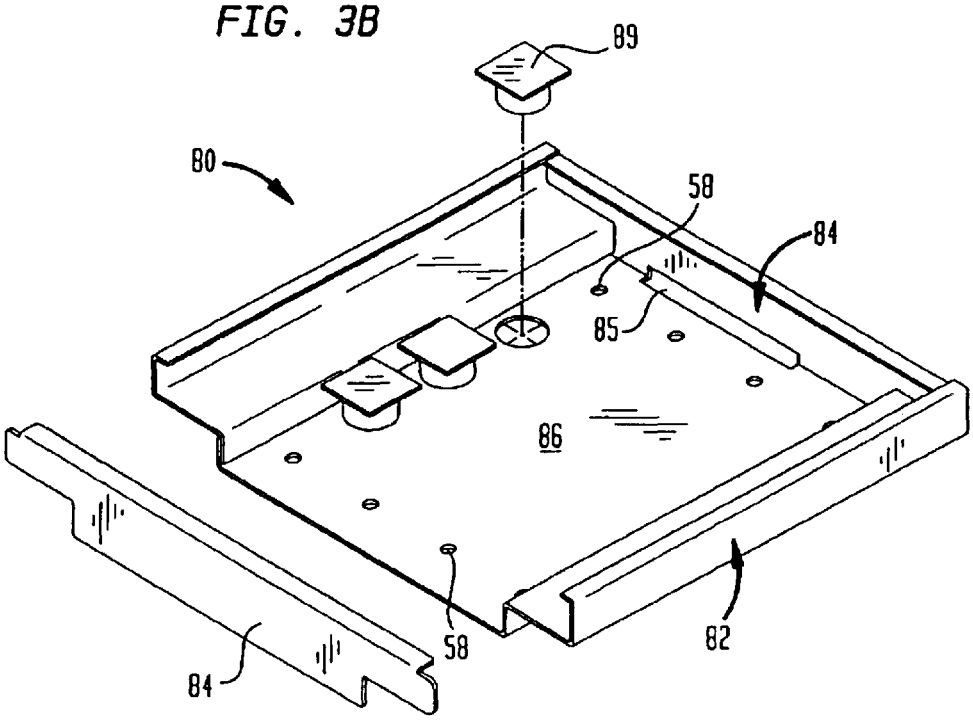
FIG. 3*b* is a perspective view of the side panel shell shown in FIG. 3*a* in a subsequent state of manufacture.

Referring now to FIGS. 3 through 5, the sequence steps in forming the panels is shown. A typical side panel is formed from a flat metal sheet which can be bent along edges thereof to form side walls 82 of side panel sheet 80. Alternatively, the side walls 82 can be separately formed and attached by welding 85 or other means to bottom plate 86. The side panel shell 80 comprises a shell bottom plate 86, and two side walls 82. Also, two shell end walls 84, also typically made of a sheet metal material, and are attached by welding or other means to the bottom shell plate 86 to form the basic side panel shell 80. Prior to forming or attaching the walls to the bottom plate, the shell bottom plate 86 has attachment bolt apertures 58 punched out at both the top and bottom edges thereof. If the side wall will receive lock bolts from the door of the safe, the shell bottom plate 86 is further punched with locking bolt apertures 88 along an edge thereof These locking bolt apertures are then covered with covers 89 which comprise cylindrical bodies and caps and which define the bolt receiving space during the remaining fabrication steps.

Figure 4A:
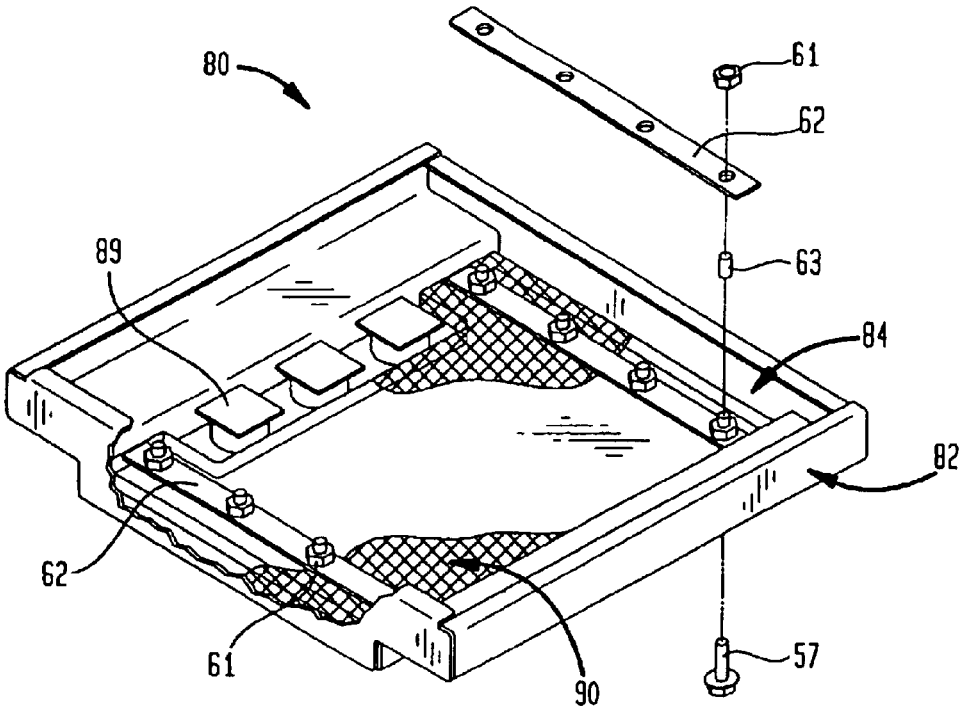
FIG. 4*a* is a perspective view of the side panel shell shown in FIG. 3*b* in a subsequent stage of manufacture with attachment bolts and a first layer of expanded metal.
Figure 4B:
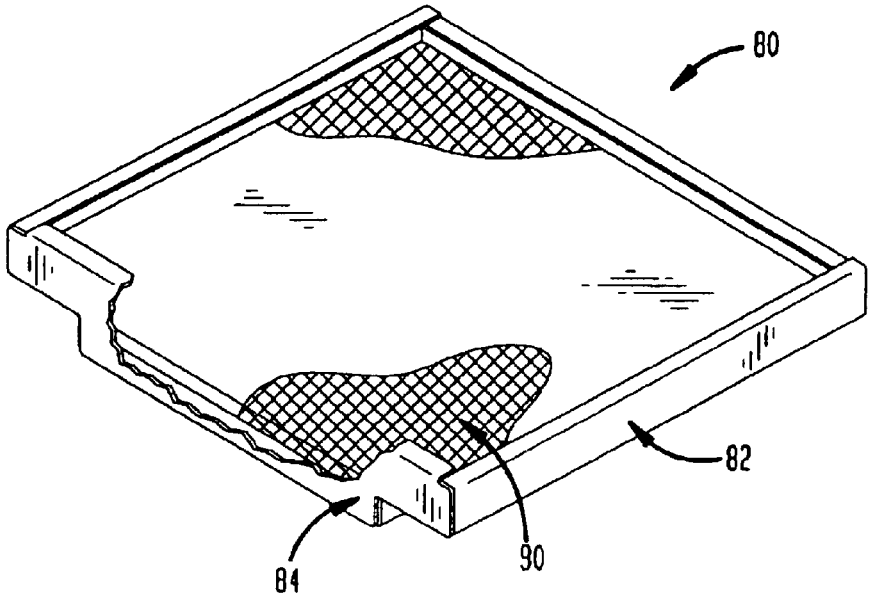
FIG. 4*b* is a perspective view of the side panel shell of FIG. 4*a* with second layer of expanded metal.

FIGS. 4*a* and 4*b* show the next steps involved in the construction of the side panel. First, attachment bolts 57 are fitted through the attachment bolt apertures 58. The attachment bolts 57 are then fitted with attachment plate 63. Thereafter a layer of expanded metal 90 is placed within the shell and covers the entire shell bottom plate 86 with the exception of the space occupied by the locking bolt aperture covers 89. Next, the attachment bolts 57 are fitted through an attachment bolt plate 62 and locked into place by attachment nuts 61. Then, a second layer of expanded metal 90 is positioned with the shell over the first layer.

Figure 5A:
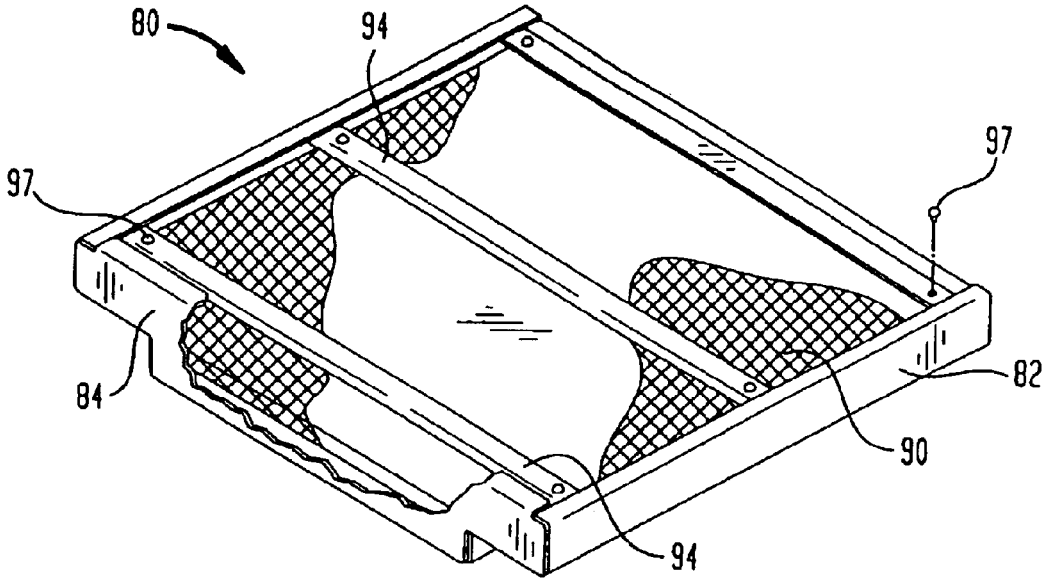
FIG. 5*a* is a perspective view of the side panel shell of FIG. 4*b* with support brackets prior to the final pouring of concrete filler.
Figure 5B:
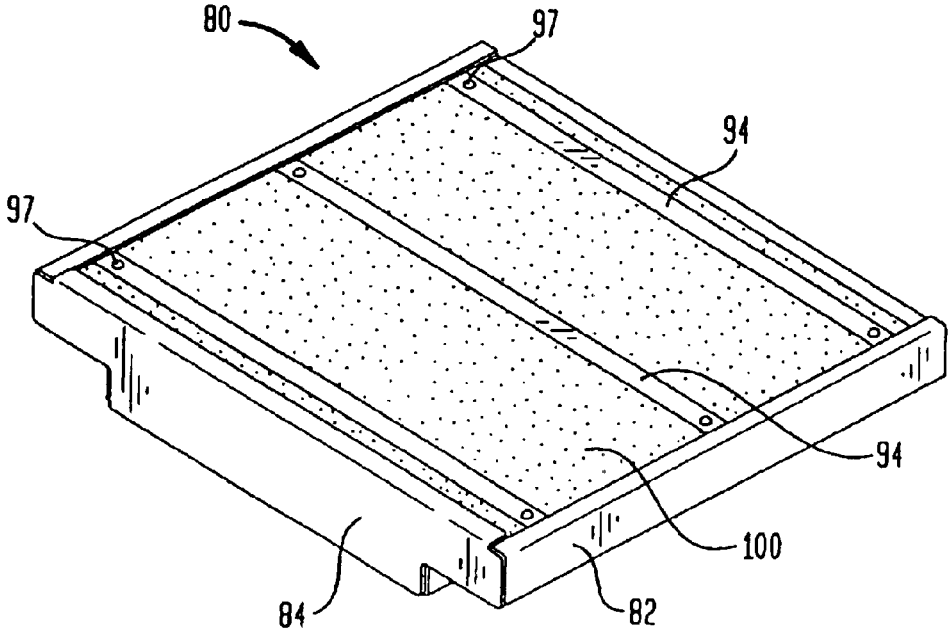
FIG. 5*b* is a perspective view of the side panel shell of FIG. 5*a* complete with the last layer of concrete filler.

FIGS. 5*a* and 5*b* detail the final steps of construction. The second layer of expanded metal 90 is secured in place by support brackets 94 which are held in place by support bolts 97. Then, a single pour of high density concrete 100 is poured into the shell. Then the shell is vibrated to permit the concrete to settle, and the concrete is allowed to set. Importantly, the panel is constructed with the smaller, inner portion down so that only one pour is necessary. At this point all that is required is the attachment of a cover or fascia plate of any desired material which can be glued or otherwise attached to the exterior of the panel to provide any desired appearance. This step can be performed before or after the construction of the safe.

Construction of the top and bottom panes 30 and 40 follow generally the same method of construction. Likewise, the door 21 is a panel and does not require any special top and bottom filler panels.

It should be noted that the concrete can be formulated in accordance with the requirements of the application. For example, high density concrete can be used for high security application, while ready mix or other more economic concrete mixtures can be used in connection with lower security applications. Further, the other components of the panels, i.e. the expanded metal or reinforcement plates or aluminum or stone can be varied as desired.

After the panels set, the attachment bolts 57 and anchor bolts are removed from the panels. Security bolt boxes 50 are then placed on both the top and bottom panels 30 and 40, and are fixed in place with the anchor bolts which pass through the anchor bolt apertures 56 of the security bolt box 50 and into security anchor bolt apertures at the top and bottom panel 30 and 40 where they are locked into place by anchor nuts 61 which remain within the panels from the panel fabrication process. The back and side panels 60 and 70 can then be attached to both the top and bottom security bolt boxes 50 and are fixed into place by the attachment bolts which pass through the attachment bolt apertures of the security bolt boxes fixed into place by the attachment nut to form the basic enclosure of the safe. Finally a hinged door can be affixed to the open wall to provide a complete security enclosure. Importantly, the on-site assembly process can be conducted on a ground-up basis. In other words, the bottom panel is positioned in a desired location and then the back and side panels placed thereon and attached thereto. The bottom thereby provides a flat, even work base or foundation. Also, with reference back to FIGS. 1*a* and 1*b*, it can be seen that the top and bottom panels 30 and 40 extends past the side walls 70 and rear wall 60 to optically hide the abutting seams of the vertical panels.

Finally, the inside of the safe can be finished off with a plate 55 that sits on top of upstanding walls 54 of the security bolt box 50. Preferably, such a cover has a depending side wall at one side for covering the forward base seam between the security bolt box and the inner portion 34 or 44 of the top or bottom panel 30 or 40. This cover plate can be screwed down on a bolt box and/or can be hingedly attached to provide for a "secret compartment." Referring now to FIGS. 6*a*, 6*b*, and 6*c*, another embodiment of the modular security safe of the present invention is shown. The modular security safe is generally indicated at 120 and includes a top panel 130, a bottom panel 140, and back and side panels 170. These panels, 130, 140, and 170, the structure of which will be further discussed hereinafter, are interconnected by means of security bolt boxes 150 which attach the panels together to form a safe. Top panel 130 includes an outer portion 132 with an outer surface 133 and an inner portion 134 with an inner face 135. The inner portion 134 is generally smaller than the outer portion 132 in terms of length l and width w. A rabbet face 136 created on the outer portion 132 which, in connection with the perimeter 137 of the inner portion 134, forms a step between the inner portion 134 and the outer portion 132.

Similarly, the bottom panel 140 includes an outer portion 142 with an outer surface 143 and an inner portion 144 with an inner surface 145. The inner portion 144 is generally smaller than the outer portion 142 in terms of length l and width w. A rabbet face 146 is created on the outer portion 142, which in connection with the perimeter 147 of the inner portion 144, forms a step between the inner portion 144 and the outer portion 142.

Attached to the inner surface 135 of the inner portion 134 of the top panel 130 is a security bolt box generally indicated at 150. Likewise, a security bolt box 150 is attached to the inner surface 145 of the inner portion 144 of the bottom panel 140. The security bolt box 150 includes a bottom face 152 and upstanding walls 154 to form a tray like configuration. The upstanding walls 154 can be interconnected with the bottom face 152 or can be formed through a bending and folding operation as previously described. The security bolt box 150 is attached to the inner portion 134 of top panel 130 and inner portion 144 of bottom panel 140 by means of anchor bolts (not shown) which extend through the anchor bolt box apertures 156 in the security bolt box 150. The security bolt box 150 is also provided with attachment bolt apertures 158 extending about the upstanding walls 154 for receiving attachment bolts not shown to attach side and back panels 170 with the top and bottom panels 130 and 140 to form a safe. Importantly, the upstanding side walls 154 of the security bolt box 150 are recessed from the edges of inner portion 144 to provide an exposed portion of the inner surface 145 of inner portion 144 for facilitating interconnection of the top and bottom panels with the side and back panels 170.

The side and back panels 170 include outer portions 172 and inner portions 174. The outer portions 172 include an outer surface 173 and the inner portions 174 includes an inner surface 175. Like the top panel and bottom panel, the inner portions 174 are stepped in relation to the outer portion 172 creating a rabbet face 176 which extends about all four sides of the side and back panels 170. Upper and lower surfaces of inner surfaces 175 of the side and back panels 170 include apertures for receiving attachment bolts (not shown) that extend through the security bolt boxes 150 to join the side walls 170, back wall 170 and top and bottom panels 130 and 140.

Front panel 121 is constructed similarly to side and pack panels 170 with an outer portion and a stepped down inner portion along all edges of the outer portion. The front panel 121 can be hingedly attached to one side wall 170.

Figure 6A:
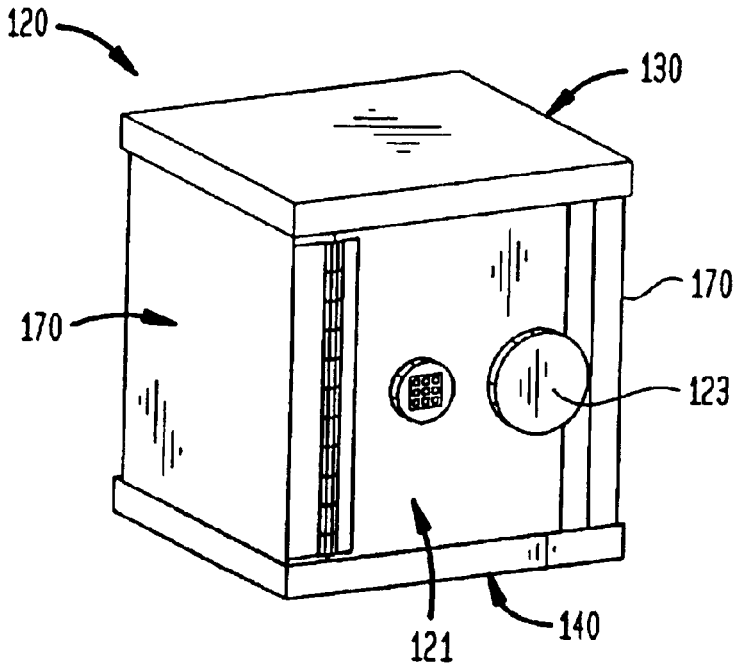
FIG. 6*a* is an alternate perspective view of the modular security safe of the present invention shown in an assembled form.
Figure 6B:
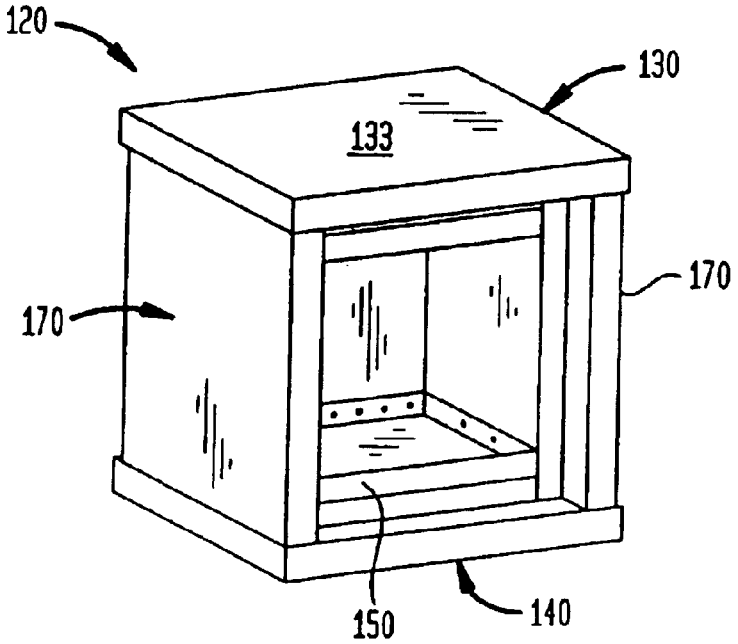
FIG. 6*b* is a perspective view of the apparatus of FIG. 6*a* with the door of the safe removed.
Figure 6C:
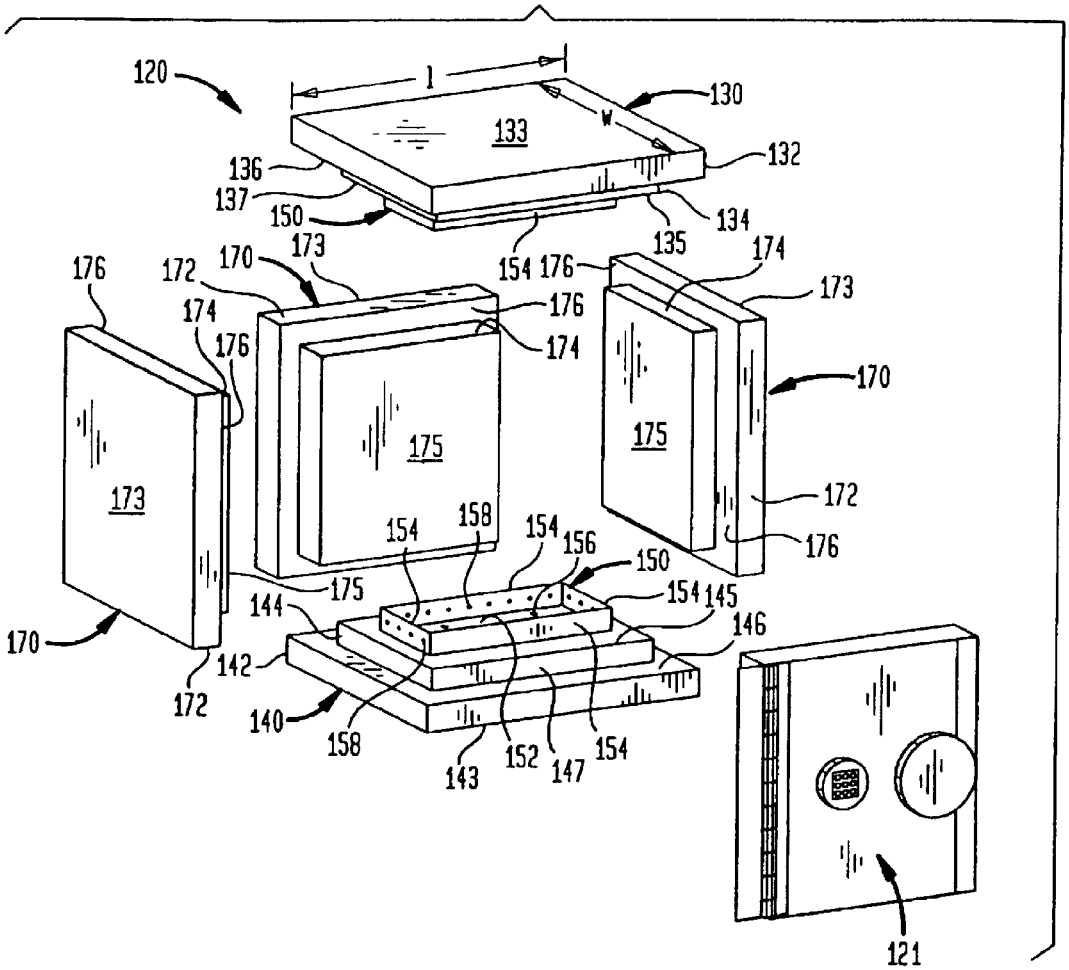
FIG. 6*c* is an exploded perspective view of the apparatus of FIG. 6*a*.

The panels shown in FIGS. 6*a*–6*c* can be constructed in the same manner as previously disclosed herein.

Figure 7A:
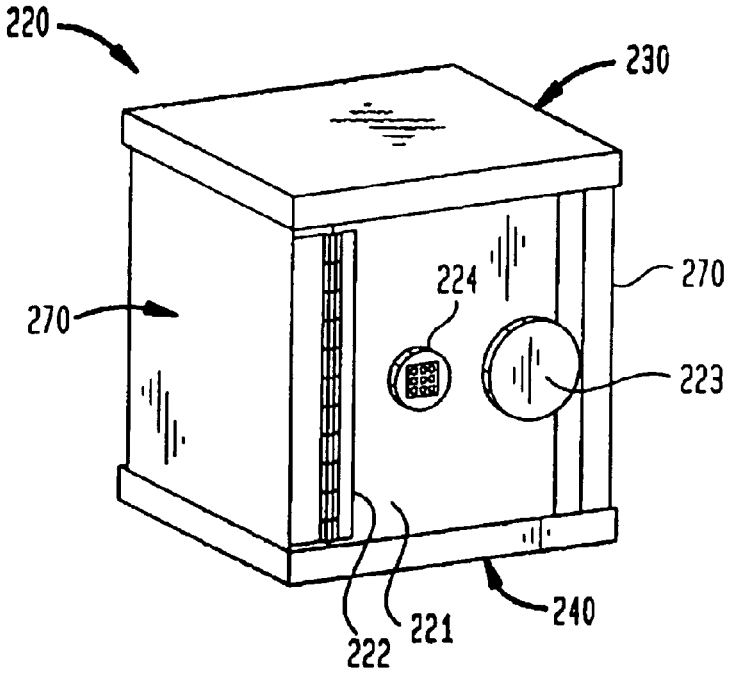
FIG. 7*a* is a perspective view of an alternate embodiment of the modular safe of the present invention in assembled form.
Figure 7B:
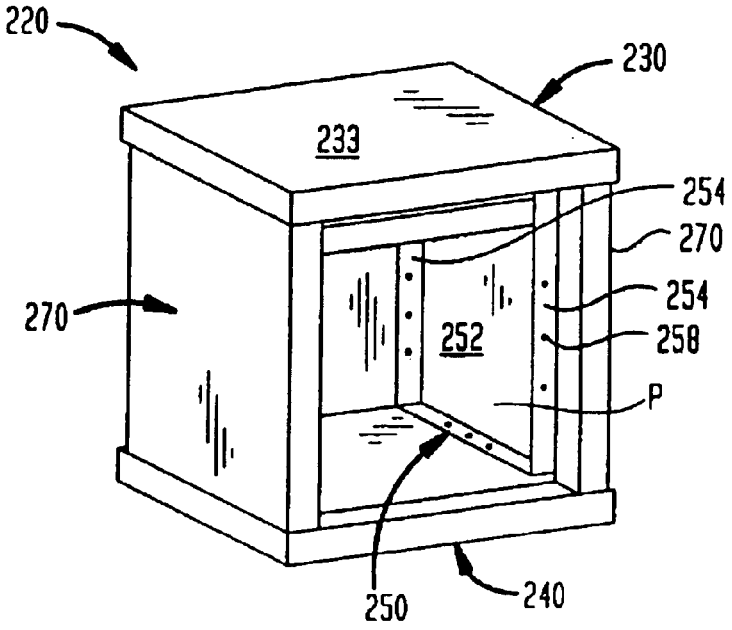
FIG. 7*b* is a perspective view of the apparatus shown in FIG. 7*a* with the door of the safe removed.
Figure 7C:
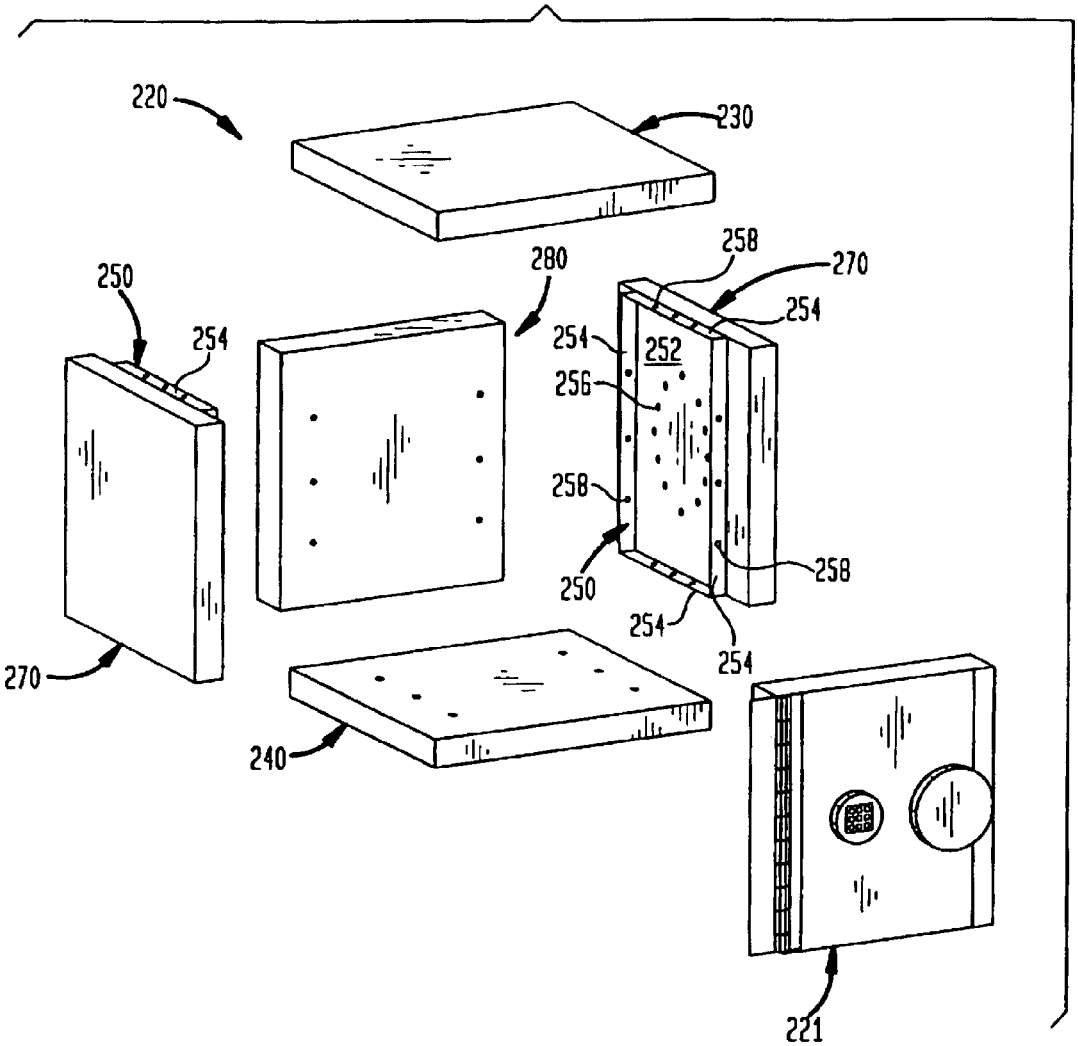
FIG. 7*c* is an exploded perspective view of the apparatus of FIG. 7*a*.

Referring now to FIGS. 7*a*–7*c*, another embodiment of the modular security safe of the present invention is shown. The modular security safe generally indicated at 220 and includes a top panel 230, a bottom panel 240, back panel 280 and side panels 270. These panels 230, 240, 270, and 280, the structure of which will be further discussed hereinafter, are interconnected by a means of security bolt boxes 250 which attach the panels together to form a safe. Each of the panels 230, 240, 270, and 280 include an outer face and an inner face. Opposing side panels 270 have security bolt boxes 250 attached thereto. The security bolt boxes 250 include bottom faces 252 and upstanding walls 254 to form a tray-like configuration. The upstanding panels 254 can be interconnected with the bottom face 252 or can be formed by a bending and forming operation as previously described. The opposing side panels 270 by means of anchor bolts (not shown) which extend through anchor bolt box apertures 256 provide with attachment bolt apertures 258 extending through the upstanding walls 254 for receiving attachment bolts (not shown) to attach opposing side panels 270 with top and bottom panels 230, 240 and back panel 280 to form a safe. Importantly, the upstanding side panels 254 of the security bolt box 250 are recessed from the forward and rearward edges of opposing side panels 270 to allow for positioning of rear panel 280 and front panel 221. The security bolt boxes 250 are flush with the upper and lower edges of the opposing side panels 270. The opposing side panels 270 as well as back panel 280 sit on bottom panel 240. Likewise, top panel 230 sits on top of opposing side panels 270 and back panel 280. The front panel 221 can be hingedly attached to one side panel 270.

The panels shown in FIGS. 7*a*–7*c* can be constructed in the same manner as previously disclosed herein.

Figure 8:
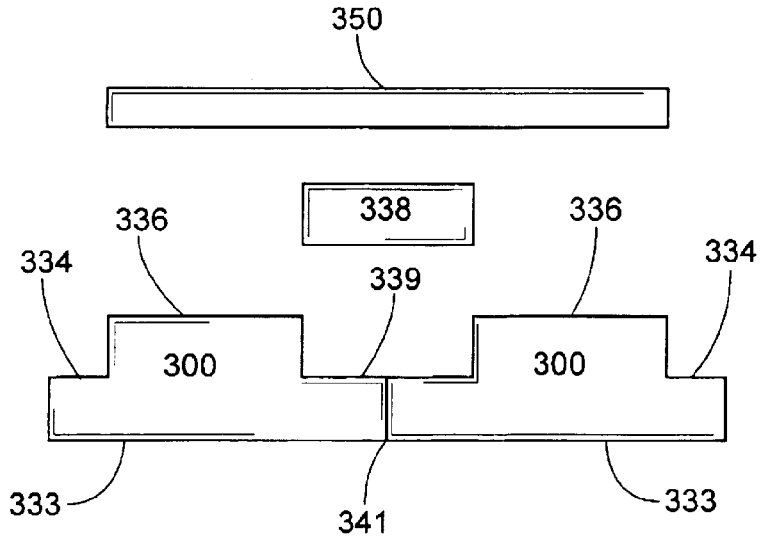
FIG. 8 is an end view illustrating two adjacent panels, security bolt box and filler block.

FIG. 8 is a side view of two panels 300 positioned adjacent each other, each panel includes an outer surface 333 and an inner surface 334, the inner surface 334 having a rabbet face 336. These panels are identical to those illustrated in FIG. 6*c*. In the embodiments heretofore discussed, one panel 300 would be used to form the bottom of a safe, and one panel each would be used to form the side panels of a safe with another identical panel 300 being used to form the upper wall of the safe. The remaining open wall would accept a mounted pivotal door allowing access to the safe. In this further embodiment, such a safe as that illustrated in FIG. 6*c* may be expanded using identical panels in addition to a reconfigured security bolt box and a filler block.

In FIG. 8, the two panels 300 are positioned adjacent each other, each having an identical interior rabbetted face 336. A filler block 338 is dimensioned to snugly fit between the slotted gap 339 between the two rabbetted faces 336. Filler block 338 is constructed in the same manner as panels 300 as heretofore previously discussed. A security bolt box 350 would then be secured to the two adjacent panels 300, the security bolt box spanning the rabbetted faces 336 and the filler block 338 maintaining the filler block in position. In this configuration it can be seen that the seam 341 between adjacent panels 300 is not continuous from the exterior surface 333 of adjacent panels 300 to the interior of the safe. The filler block 338 serves to block the seam and prevents a would be safe cracker or robber from using such seam 341 as a means of ingress into the safe.

Figure 9:
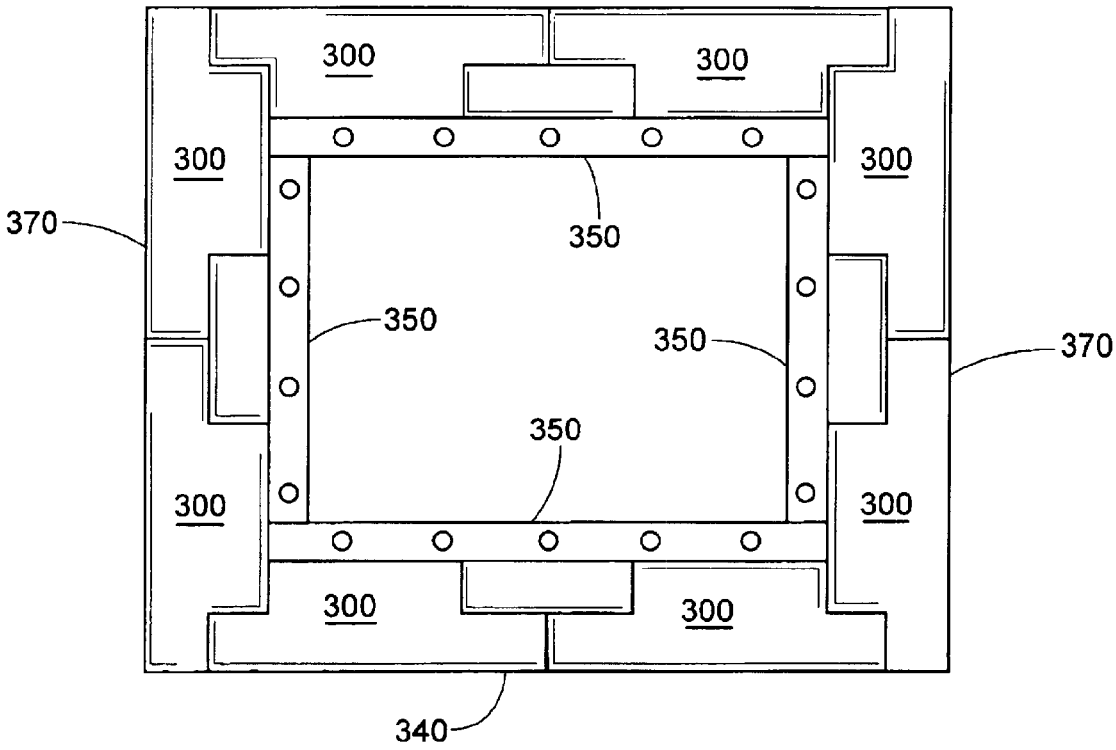
FIG. 9 is a front cross sectional view of a safe with the door removed illustrating the cooperativeness of the panels, filler block and security bolt box.

FIG. 9 is a cross sectional view of the safe 120 as illustrated in FIG. 6*c* wherein Applicant's expandability capability has increased the volume of the safe by a factor of 4. FIG. 9 presents a cross sectional view for better understanding. In FIG. 9, a series of identical panels 300 have been juxtaposed adjacent each other such that two panels 300 form the base 340 of the safe, two juxtaposed panels 300 form one side 370 of the safe, two juxtaposed panels 300 form the opposing side 370 of the safe and two juxtaposed panels 300 form the upper surface of the safe. In each instance, a filler block 338 is fit within the slot 339 formed by adjacent rabbetted surfaces 336 of adjacent panels 300 thereby interrupting and blocking the seam 341 formed between such adjacent panels 300. A security bolt box 350 is then secured to the bottom, sides and top walls of the interior surface of the panels formed by the rabbetted face and the filler block and secured in place. In this manner, the security bolt box 350 secures the panels 300 and the filler block 338.

In the cross section illustrated in FIG. 9, the depth of the safe, similar to that illustrated in FIG. 6*c* has not been increased, rather the width and the height have been doubled to increase the volume of the safe by a factor of four. The rear wall would be assembled in the same manner as that described with respect to the bottom, top and side walls with the understanding that four panels 300 and associated filler blocks 338 would be required to provide a continuous rear wall with the side, top and bottom walls illustrated. The same would hold true for the front wall (not shown) and the incorporation in the front wall of a door means, hinge, handle and combination lock as illustrated in FIG. 6*c*.

Having thus described the invention in detail, it is to be understood that the foregoing description is not intended to limit the spirit and scope thereof What is desired to be protected by Letters Patent is set forth in the appended claims.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof

I claim:

1. A modular, expandable safe comprising:

a plurality of panels, each having a planar outer surface and a rabbetted inner surface, said panels selectively juxtaposed adjacent each other to form opposing side walls, top wall, rear wall, and bottom wall of a safe;

a filler block dimensioned to be secured between adjacent inner rabbetted surfaces of said adjacent panels to block a seam formed between said panels when juxtaposed;

security bolt boxes interconnected with the inner surfaces of said panels securing said adjacent panels and filler blocks;

said bottom wall, said rear wall, and said top wall interconnected with said opposing side walls by bolts extending through said security bolt boxes attached to said side walls; and a door hingeably interconnected with one side wall and lockable with respect to an opposing side wall.

2. The modular expandable safe in accordance with claim 1 wherein said security bolt boxes are interconnected with said side walls by anchor bolts.

3. The modular expandable safe in accordance with claim 1 wherein said security bolt boxes comprise bottom plates and upstanding side walls.

4. The modular expandable safe in accordance with claim 3 wherein said bolt boxes are formed of a single sheet of material with upstanding walls bent to extend from said bottom plates at a 90 degree angle.

5. The modular expandable safe in accordance with claim 1 wherein said panels are juxtaposed adjacent each other with said filler block so as to permit fabrication of a modular expandable safe selectively having increased width, increased height, and/or increased depth.

* * * * *